US008117978B2

(12) United States Patent
Ouchi et al.

(10) Patent No.: US 8,117,978 B2
(45) Date of Patent: Feb. 21, 2012

(54) SAILING SHIP EQUIPPED WITH A HARD SAIL

(75) Inventors: Kazuyuki Ouchi, Nagano (JP); Gaku Kimura, Sizuoka (JP)

(73) Assignees: Ouchi Ocean Consultant, Inc., Nagano (JP); GH Craft Ltd., Sizuoka (JP)

( * ) Notice: Subject to any disclaimer, the term of this patent is extended or adjusted under 35 U.S.C. 154(b) by 83 days.

(21) Appl. No.: 12/701,411

(22) Filed: Feb. 5, 2010

(65) Prior Publication Data

US 2010/0199905 A1 Aug. 12, 2010

(51) Int. Cl.
*B63H 9/04* (2006.01)

(52) U.S. Cl. ..... 114/102.15; 114/102.29; 114/104

(58) Field of Classification Search ..... 114/102.1, 114/104, 102.15, 102.29
See application file for complete search history.

(56) References Cited

U.S. PATENT DOCUMENTS 4,561,374 A * 12/1985 Asker ..... 114/102.17
4,685,410 A * 8/1987 Fuller ..... 114/39.31

FOREIGN PATENT DOCUMENTS

DE 3107096 A1 * 9/1982 ..... 114/102.22
JP 2005-280533 A 10/2005
JP 2009-214633 A 9/2009

OTHER PUBLICATIONS

K. Ouchi, "R & D Strategy for the Technologies of Ship's Energy Saving and Zero-Emission," paper published at the symposium superintended by Japan Society of Naval Architects and Ocean Engineers, May 28-29, 2009, pp. 155-158.
K. Ouchi et al., "Concept Design of Wind Driven Vessel in the Era of Low Carbon Society," 21 Ocean Engineering Symposium superintended by Japan Society of Ocean Engineers and Japan Society of Naval Architects and Ocean Engineers, Aug. 6-7, 2009.

* cited by examiner

*Primary Examiner* — Stephen Avila
(74) *Attorney, Agent, or Firm* — Griffin & Szipl, P.C.

(57) ABSTRACT

A sailing ship comprises a hard sail assembly. The hard sail assembly comprises a plurality of hard sails of wing-shaped hollow cross section. The hard sails are vertically stacked so that each except the lowermost is received in the one immediately below. The sailing ship further comprises an apparatus for driving the hard sails to move each except the lowermost toward and away from the one immediately below, a post extending vertically to support the lowermost hard sail, and a second apparatus for rotating the post around its longitudinal axis. Overlapping lengths between vertically adjacent hard sails are variably controlled to make the hard sail assembly expand and contract vertically.

2 Claims, 2 Drawing Sheets

SAILING SHIP EQUIPPED WITH A HARD SAIL

This application is related to Japanese Patent Application No. 2008-058842, filed Mar. 8, 2008, and published on Sep. 24, 2009 as Japanese Patent Publication No. 2009-214633. The entire disclosures of the above-applications are incorporated herein by reference.

BACKGROUND OF THE INVENTION

The present invention relates to a sailing ship equipped with a hard sail.

A sailing ship equipped with a hard sail is disclosed in Japanese Patent Laid-Open Publication No. 2005-280533.

The hard sail can be contracted transversely but its height cannot be changed. Therefore, the hard sail may obstruct passage of the ship under bridges.

SUMMARY OF THE INVENTION

An object of the present invention is to provide a sailing ship equipped with a hard sail of changeable height.

In accordance with the present invention, there is provided a sailing ship equipped with a hard sail comprising a hard sail assembly comprising a plurality of hard sails of wing-shaped hollow cross section vertically stacked so that each except the lowermost is received in the one immediately below, first means for driving the hard sails to move each except the lowermost toward and away from the one immediately below, a post extending vertically to support the lowermost hard sail, and second means for rotating the post around its longitudinal axis, wherein overlapping lengths between vertically adjacent hard sails are variably controlled to make the hard sail assembly expand and contract vertically.

In the sailing ship equipped with a hard sail of the present invention, the first means drives the hard sails to move each except the lowermost toward and away from the one immediately below to variably control overlapping lengths between vertically adjacent hard sails, thereby changing the height of the hard sail assembly. The second means directs the expanded hard sail assembly in the optimum direction relative to the wind.

In the sailing ship equipped with a hard sail of the present invention, the hard sail assembly comprises a plurality of hard sails vertically stacked so that each except the lowermost is received in the one immediately below and can expand and contract to change its height. Therefore, the height of the hard sail assembly can be adjusted so as not to obstruct passage of the ship under bridges.

In accordance with a preferred embodiment of the present invention, each hard sail is provided with members for maintaining the wing-shaped hollow cross section at the lower end and near the upper end. The member near the upper end is a frame surrounding the outer circumferential surface of the hard sail. The frame abuts the upper end of the hard sail immediately below to prevent the downward movement of the hard sail relative to the hard sail immediately below.

It is desirable to provide each hard sail with members for maintaining the wing-shaped hollow cross section at the lower end and near the upper end. The member near the upper end is desirably a frame surrounding the outer circumferential surface of the hard sail to abut the upper end of the hard sail immediately below when the hard sail assembly contracts, thereby preventing the downward movement of the hard sail relative to the hard sail immediately below. Thus, the contracted hard sail assembly becomes stable.

In accordance with a preferred embodiment of the present invention, the first means comprises swing arms engaging the members for maintaining the wing-shaped hollow cross section provided at the lower ends of the hard sails vertically adjacent to each other, and third means for driving the swing arms to make them swing.

When swing arms engage the members for maintaining the wing-shaped hollow cross section provided at the lower ends of the hard sails vertically adjacent to each other, and the third means drives the swing arms to make them swing, the upper hard sails move toward and away from the hard sails immediately below. Thus, overlapping lengths between vertically adjacent hard sails can be variably controlled.

DETAILED DESCRIPTION OF THE PREFERRED EMBODIMENTS

Preferred embodiments of the present invention will be described.

Figure 1:
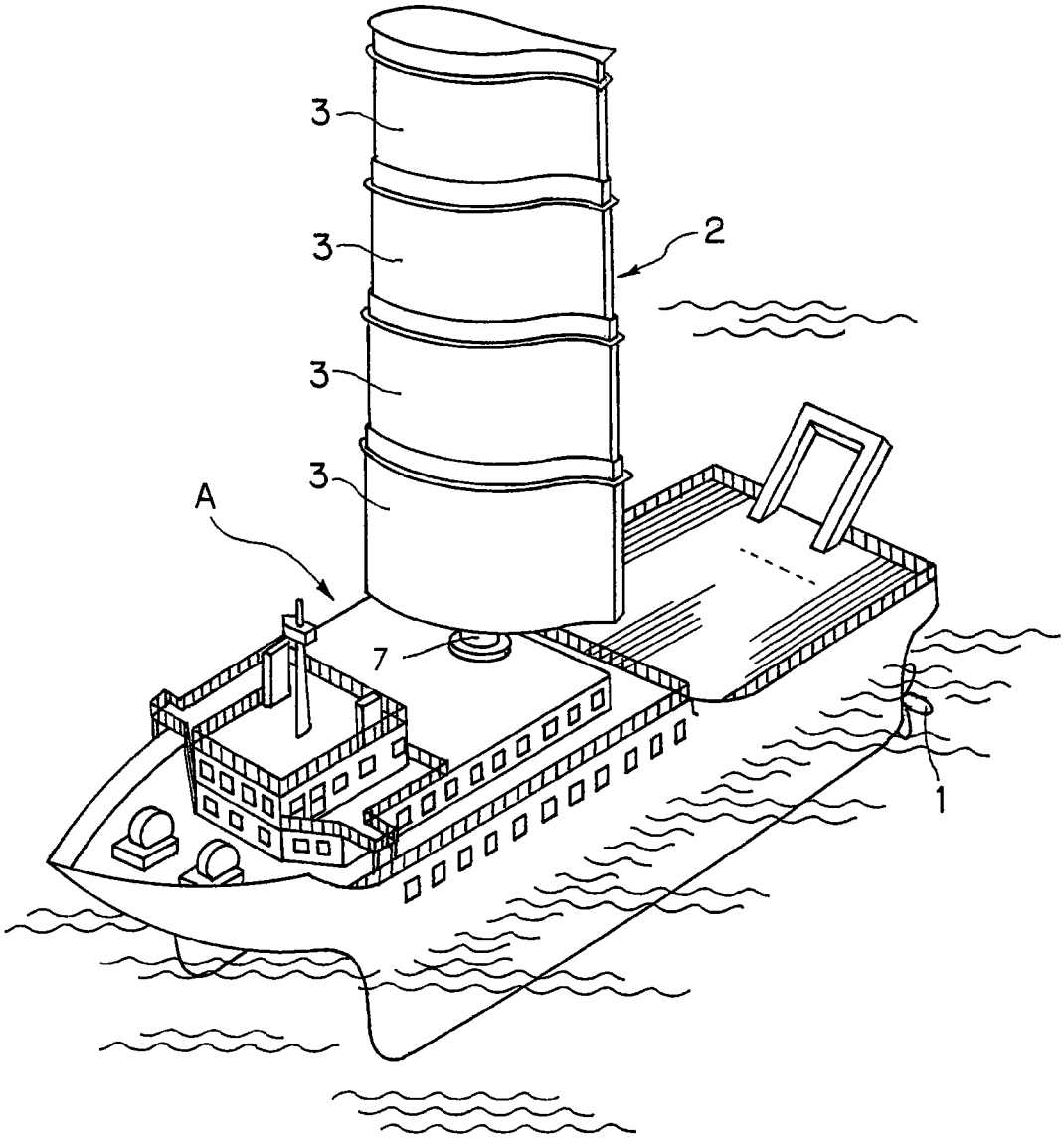
FIG. 1 is a perspective view of an ocean research ship in accordance with a preferred embodiment of the present invention.
Figure 2:
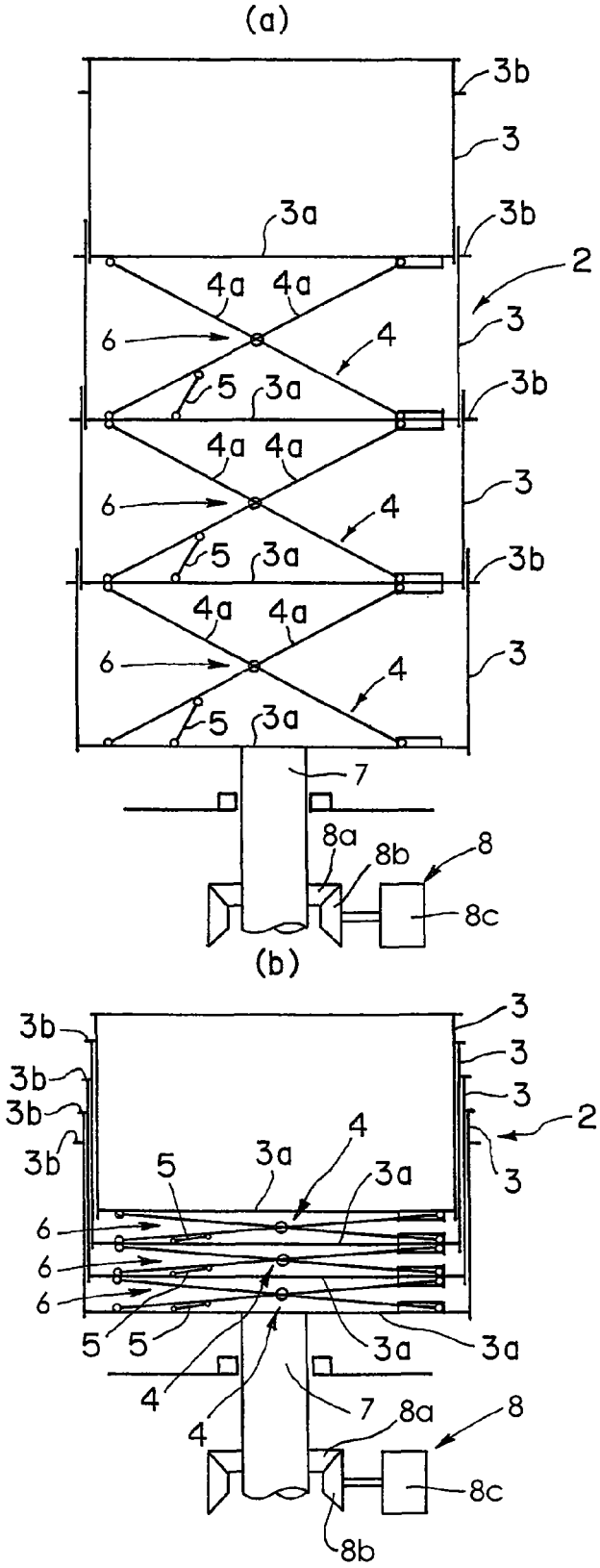
FIG. 2 is a set of sectional views of a hard sail assembly of the ocean research ship in accordance with a preferred embodiment of the present invention, in which (a) is a view in expanded condition and (b) is a view in contracted condition.

As shown in FIG. 1, a catamaran type ocean research ship A is equipped with a propeller propulsion unit 1 and further with a wind-force propulsion unit of hard sail assembly 2. The hard sail assembly 2 is, as shown in FIGS. 1 and 2, provided with four hard sails 3 made of carbon fiber reinforced plastic. The four hard sails 3 are vertically stacked. Each of the hard sails 3 has a symmetrical wing-shaped hollow cross section. Each of the upper three hard sails 3 is telescopically received in the hard sail 3 immediately below. Each hard sail 3 is provided with a bottom plate 3*a* and with a frame 3*b* surrounding the outer circumferential surface of a region near the upper end of the hard sail 3.

A pantograph 4 is provided between each pair of vertically adjacent hard sails 3 to engage the bottom plate 3*a* of the upper hard sail 3 and the bottom plate 3*a* of the lower hard sail 3 through articulated couplings. A hydraulic jack 5 is provided to drive one of the two cross arms 4*a* forming the pantograph 4 to make it swing. The pantograph 4 and the hydraulic jack 5 constitute a first driving mechanism 6 for vertically moving the upper hard sail 3 toward and away from the lower hard sail 3. The ocean research ship A is provided with three first driving mechanisms 6. Therefore, each of three hard sails 3 located above the lowermost hard sail 3 can move vertically toward and away from the hard sail 3 immediately below.

The ocean research ship A is provided with a post 7 extending vertically through a deck to support the lowermost hard sail 3, and a second driving mechanism 8 for rotating the post 7 around its longitudinal axis. A pair of bevel gears 8*a*, 8*b* engaging each other and an electric motor 8*c* rotating the bevel gear 8*b* constitutes the second driving mechanism 8. A circular swivel bearing provided with external teeth, a pinion engaging the external teeth of the swivel bearing and an electric motor for rotating the pinion which are not shown in FIGS. 1 and 2 also can constitute the second driving mechanism 8.

Operation of the hard sail assembly 2 will be described.

When the ocean research ship A uses the hard sail assembly 2, the hydraulic jacks 5 of the first driving mechanisms 6 extend as shown in FIG. 2 (*a*) to expand the pantographs 4 upward, thereby moving the upper three hard sails 3 to working positions where each is distanced from the hard sail 3 immediately below. Thus, the hard sail assembly 2 expands. The overlapping lengths between vertically adjacent hard sails 3 become minimum. The bottom plate 3*a* of each of the upper three hard sails 3 comes to be located at the same height level as the frame 3*b* of the hard sail 3 immediately below. Thus, two members with large rigidities 3*a* and 3*b* are positioned at the same height level to prevent deformation of the overlapped portion of the two vertically adjacent hard sails 3, thereby preventing each of the upper three hard sails 3 from coming out the hard sail 3 immediately below under transverse wind load. The second driving mechanism 8 operates to rotate the post 7 around its vertically-extending longitudinal axis, thereby directing the hard sail assembly 2 in the optimum direction relative to the wind. The catamaran type ocean research ship A navigates using the thrust of the propeller propulsion unit 1 plus the additional thrust of the hard sail assembly 2.

When the ocean research ship A does not use the hard sail assembly 2, the hydraulic jacks 5 of the first driving mechanisms 6 contract as shown in FIG. 2 (*b*) to retract the pantographs 4 downward, thereby moving each of the upper three hard sails 3 to retracted position where it is close to the hard sail 3 immediately below. Thus, the hard sail assembly 2 contracts. The overlapping lengths between vertically adjacent hard sails 3 become maximum. The frame 3*b* of each of the upper three hard sails 3 abuts the upper end of the hard sail 3 immediately below to operate as a stopper, thereby preventing each of the upper hard sails 3 from moving downward relative to the hard sail 3 immediately below. Thus, the hard sail assembly 2 stably contracts.

In the ocean research ship A, the hard sail assembly 2 comprises a plurality of hard sails 3 vertically stacked so that each except the lowermost is received in the one immediately below and can expand and contract to change its height. Therefore, the height of the hard sail assembly 2 can be adjusted so as not to obstruct passage of the ship under bridges.

Various kinds of ships such as commercial ships, passenger ships, etc. can be equipped with the hard sail assembly 2.

The invention claimed is:

1. A sailing ship comprising:

(a) a hard sail assembly comprising a plurality of hard sails of wing-shaped hollow cross section vertically stacked so that each sail, except a lowermost sail, is received in the one immediately below, wherein each hard sail is provided with members for maintaining the wing-shaped hollow cross section at a lower end and near an upper end, wherein the member near the upper end is a frame surrounding an outer circumferential surface of the hard sail, and the frame abuts the upper end of the hard sail immediately below to prevent downward movement of the hard sail relative to the hard sail immediately below;

(b) a first means for driving the plurality of hard sails to move each sail, except the lowermost sail, toward and away from the one immediately below;

(c) a post extending vertically to support the lowermost hard sail; and (d) a second means for rotating the post around a longitudinal axis, wherein overlapping lengths between vertically adjacent hard sails are variably controlled to make the hard sail assembly expand and contract vertically.

2. A sailing ship of claim 1, wherein i. the first means comprises swing arms engaging the members for maintaining the wing-shaped hollow cross section provided at the lower ends of the hard sails vertically adjacent to each other; and ii. a third means for driving the swing arms to make the swing arms swing.

* * * * *